US007377722B2

(12) United States Patent
Spencer

(10) Patent No.: US 7,377,722 B2
(45) Date of Patent: May 27, 2008

(54) CABLE HANDLER ADAPTED TO USE WITH A VEHICLE

(76) Inventor: Bill D. Spencer, 3747 Kentucky Hwy. 451, Hazard, KY (US) 41701

( * ) Notice: Subject to any disclaimer, the term of this patent is extended or adjusted under 35 U.S.C. 154(b) by 141 days.

(21) Appl. No.: 11/481,783

(22) Filed: Jul. 6, 2006

(65) Prior Publication Data

US 2008/0006733 A1 Jan. 10, 2008

(51) Int. Cl.
*F16L 1/028* (2006.01)

(52) U.S. Cl. ..... 405/183; 405/174

(58) Field of Classification Search ..... 405/174, 405/177, 180, 183
See application file for complete search history.

(56) References Cited

U.S. PATENT DOCUMENTS

| | | | | | |
|---|---|---|---|---|---|
| 2,951,596 | A | | 9/1960 | Winder et al. | 212/289 |
| 3,170,300 | A | * | 2/1965 | Kelley | 405/180 |
| RE26,718 | E | * | 11/1969 | Kelley | 405/180 |
| 3,632,906 | A | | 1/1972 | Aihara | 191/12.2 A |
| 4,744,696 | A | * | 5/1988 | Vidler | 405/180 |
| 5,913,638 | A | * | 6/1999 | Lansdale | 405/179 |
| 6,193,215 | B1 | | 2/2001 | Glemet | 254/134.3 A |
| 6,547,508 | B2 | | 4/2003 | Perry | 414/620 |
| 2007/0286681 | A1 | * | 12/2007 | Parent | 405/174 |

* cited by examiner

*Primary Examiner*—Tara L. Mayo

(57) ABSTRACT

A cable handling accessory for use on an earth moving vehicle, such as a back hoe. The accessory replaces the front bucket of a backhoe and has cable rolled thereon.

2 Claims, 1 Drawing Sheet

CABLE HANDLER ADAPTED TO USE WITH A VEHICLE

TECHNICAL FIELD OF THE INVENTION

The present invention relates to the general art of cable handling, and to the particular field of cable handling in a mining operation.

BACKGROUND OF THE INVENTION

In a mining operation, many pieces of heavy equipment must use large electrical cables which run along the ground. These cables often measure three (3) inches or more in diameter and one (1) or more miles in length, making them very difficult to be moved by manual laborers. Therefore, there is a need for a means for efficiently moving cables on and from a mining site.

Heavy earth moving equipment typically includes multi-purpose loader buckets or backhoes which are well adept for moving and hauling sand, gravel, landfill or the like. Due to their versatility, speed and loading capacity, these vehicles are especially suitable for construction, excavation and agricultural applications.

While these vehicles are quite versatile to perform multiple earth moving functions, there are many more tasks that could be performed if such equipment were suitably modified. These vehicles are often found on a mining site. Therefore, it would be advantageous if they could be modified to handle cables and wires found on a mining site. However, the inventor is not aware of any such vehicle.

SUMMARY OF THE INVENTION

The above-discussed disadvantages of the prior art are overcome by a cable handling accessory for use on an earth moving vehicle, such as a back hoe. The accessory replaces the front bucket of a backhoe and has cable rolled thereon. The accessory is used to carry and move cable around shovels and draglines and replaces manual labor. Moving cable around a work area, such as a mining site, is thus easier than having manual labor gather the cable and carry it from place to place.

The principal purpose of the cable handler of the present invention is to keep sufficient slack in the cable to allow the draglines and shovels to move freely. When lacking sufficient slack, the cable will dislocate from the draglines and shovels causing a temporary power outage to the equipment and an electrical safety hazard. The cable handler includes spools which scoop up the cable and drag the cable along to prevent dislocation as well as preventing the cable from being snagged on any obstacles which may be present.

While the cable handler of the present invention can gather cable and move it from place to place, its principal use is to support the draglines and shovels (and any other equipment requiring large electrical cables) and to prevent damage to the cable by keeping adequate slack in the cable. Cable is hooked onto the spools of the cable holder so the cable may be pulled to the desired location.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
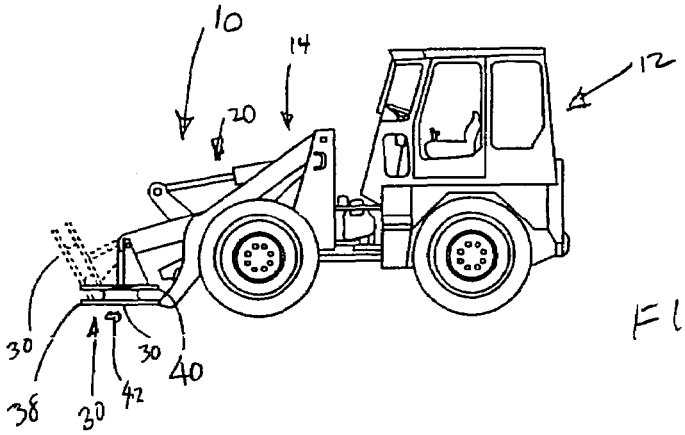
FIG. 1 is a side elevational view of an earth moving vehicle having a cable handling accessory embodying the present invention thereon.
Figure 2:
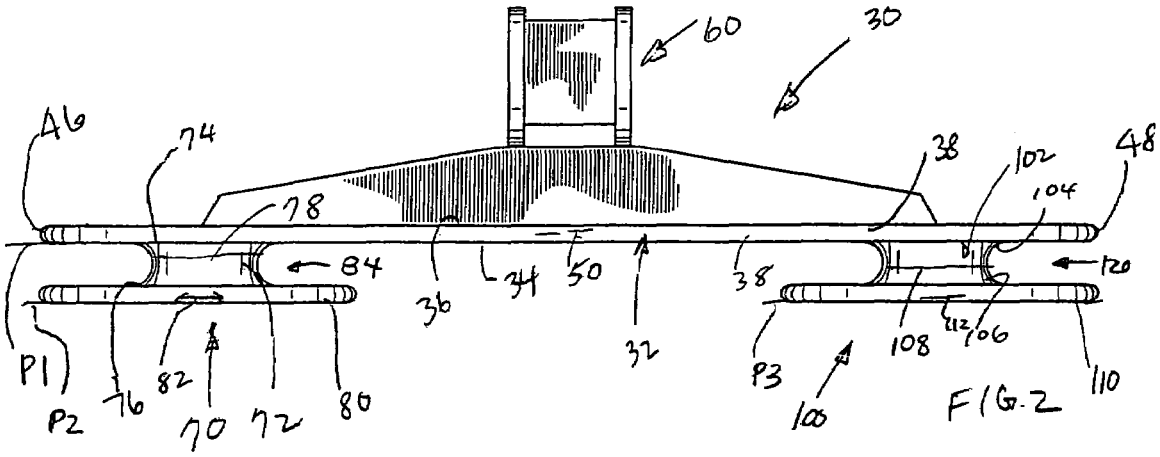
FIG. 2 is a front elevational view of the cable handling accessory embodying the present invention without cable.
Figure 3:
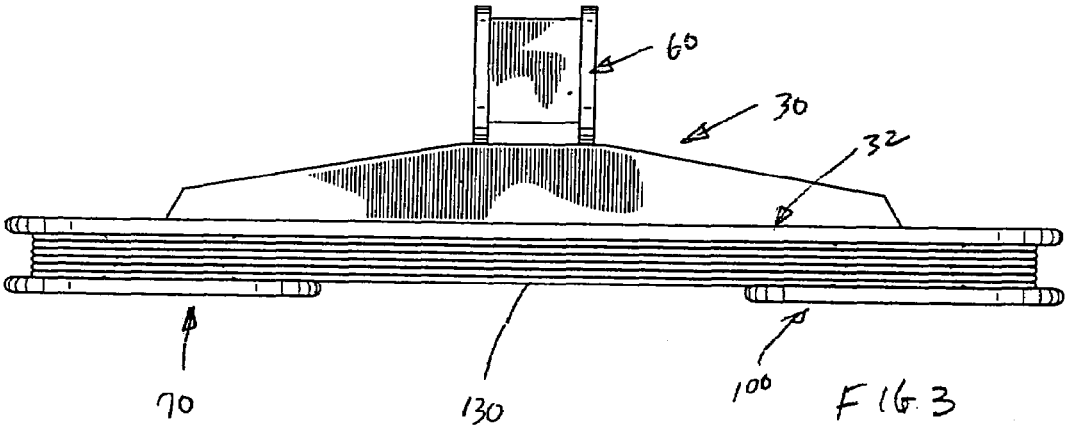
FIG. 3 is a front elevational view of the cable handling accessory embodying the present invention with cable.

Referring to the figures, it can be understood that the present invention is embodied in a cable handling accessory 10 for supporting cables and wires such as are found at mining sites or the like. Cable handling accessory 10 comprises an earth moving vehicle 12, such as a backhoe, or the like. Vehicle 12 has a first end 14 which is a front end when the vehicle is in use.

An earth moving blade moving mechanism 20 is located on the front end of the vehicle. Blade moving mechanism 20 is common to such earth moving vehicles and the details of such mechanism are not important to the present invention. As such, the details of mechanism 20 will not be claimed or discussed. Earth moving blade mechanism 20 is movable between a first position in which an earth moving blade connected to mechanism 20 is oriented at an oblique angle to the ground and a second position in which the earth moving blade connected to mechanism 20 is parallel to the ground.

A cable handler 30 includes a base 32 which has a first surface 34 which is a front surface when the cable handler is in use and a second surface 36 which is a rear surface when the cable handler is in use. Base 32 further includes a first side edge 38, a second side edge 40 and a width dimension 42 which extends between first side edge 38 and second side edge 40. Base 32 further includes a first end edge 46 which connects first side edge 38 to second side edge 38, a second end edge 48 which connects first side edge 38 to second side edge 40 and a length dimension 50 which extends between first end edge 46 and second end edge 48.

A mounting bracket 60 is located on second surface 36 of base 32 and, as indicated in FIG. 1, is sized and adapted to couple to the earth moving blade mechanism of the earth moving vehicle to be moved thereby. Base 32 is movable between a first position shown in FIG. 1 in dotted lines in which a plane P1 containing first surface 34 of base 32 is oriented at an oblique angle to the ground when the earth moving blade mechanism is in the first position thereof and a second position shown in solid lines in FIG. 1 in which plane P1 containing the first surface of the base is oriented to be parallel to the ground when the earth moving blade mechanism is in the second position thereof.

A first spool element 70 is mounted on first surface 34 of base 32 of the cable handler adjacent to first side edge 38 and adjacent to first end edge 46. First spool element 70 includes a cylindrical base 72 having a first end 74 unitary with first surface 34 of the base of the cable handler and a second end 76 spaced apart from plane P1 containing first surface 34. Cylindrical base 72 has an outer dimension 78.

A plate 80 is unitary with second end 76 of cylindrical base 72 and is oriented in a plane P2 that is parallel to plane P1. Plate 80 has an outer dimension 82 that is larger than outer dimension 78 of cylindrical base 72. A gap 84 is defined between plate 80 and first surface 34 of base 32.

A second spool element 100 is mounted on first surface 34 of base 32 adjacent to first side edge 38 and adjacent to second end edge 48. Second spool element 100 is spaced apart from first spool element 70 in the direction of length dimension 50 of base 32. Second spool element 100 includes a cylindrical base 102 has a first end 104 which is unitary with first surface 34 of base 32 and a second end 106 that is spaced apart from plane P1. Cylindrical base 102 has an outer dimension 108.

A plate 110 is unitary with second end 106 of cylindrical base 102 and is oriented in a plane P3 that is parallel to plane P1. Plate 110 has an outer dimension 112 that is larger than outer dimension 108 of cylindrical base 102 of second spool element 100. A gap 120 is defined between plate 110 and first surface 34 of base 32. The gaps 84 and 120 are sized and adapted to accommodate cable 130 which is retained on the base of the cable handler between the first surface of the base of the cable handler and the plates of the first and second spool elements to move with the base of the cable handler.

Use of cable handling accessory 10 can be understood from the teaching of the foregoing disclosure and thus will be only briefly discussed. The cable handler 30 is placed on the earth moving vehicle, such as in place of the front bucket of a backhoe, and cable is attached to the spools as necessary to move the cable and to keep proper slack on the cable.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A cable handling accessory comprising:

A) an earth moving vehicle, such as a backhoe, having (1) a first end which is a front end when the vehicle is in use, (2) an earth moving blade moving mechanism on the front end of the vehicle, (3) the earth moving blade mechanism being movable between a first position in which an earth moving blade is oriented at an oblique angle to the ground and a second position in which the earth moving blade is parallel to the ground;

B) a cable handler which includes (1) a base having (a) a first surface which is a front surface when the cable handler is in use, (b) a second surface which is a rear surface when the cable handler is in use, (c) a first side edge, (d) a second side edge, (e) a width dimension which extends between the first side edge and the second side edge, (f) a first end edge which connects the first side edge to the second side edge, (g) a second end edge which connects the first side edge to the second side edge, and (h) a length dimension which extends between the first end edge and the second end edge, (2) a mounting bracket on the second surface of the base, the mounting bracket being sized and adapted to couple to the earth moving blade mechanism of the earth moving vehicle to be moved thereby, (3) the base being movable between a first position in which a plane containing the first surface of the base is oriented at an oblique angle to the ground when the earth moving blade mechanism is in the first position thereof and a second position in which the plane containing the first surface of the base is oriented to be parallel to the ground when the earth moving blade mechanism is in the second position thereof, (4) a first spool element mounted on the first surface of the base of the cable handler adjacent to the first side edge and adjacent to the first end edge, the first spool element including (a) a cylindrical base having a first end unitary with the first surface of the base of the cable handler and a second end spaced apart from the plane containing the first surface of the base of the cable handler, the cylindrical base having an outer dimension, and (b) a plate which is unitary with the second end of the cylindrical base of the first spool element and which is oriented in a plane that is parallel to the plane containing the first surface of the base of the cable handler, the plate having an outer dimension that is larger than the outer dimension of the cylindrical base of the first spool element, and (c) a gap being defined between the plate of the first spool element and the first surface of the base of the cable handler, (5) a second spool element mounted on the first surface of the base of the cable handler adjacent to the first side edge and adjacent to the second end edge, the second spool element being spaced apart from the first spool element in the direction of the length dimension of the base of the cable handler and including (a) a cylindrical base having a first end unitary with the first surface of the base of the cable handler and a second end spaced apart from the plane containing the first surface of the base of the cable handler, the cylindrical base of the second spool element having an outer dimension, and (b) a plate which is unitary with the second end of the cylindrical base of the second spool element and which is oriented in a plane that is parallel to the plane containing the first surface of the base of the cable handler, the plate of the second spool element having an outer dimension that is larger than the outer dimension of the cylindrical base of the second spool element, and (c) a gap being defined between the plate of the second spool element and the first surface of the base of the cable handler, and (6) the gaps defined on the first and second spool elements being sized and adapted to accommodate cable which is attached to the first and second spool elements so the cable will be retained on the base of the cable handler.

2. A cable handling accessory comprising:

A) an earth moving vehicle, such as a backhoe, having (1) an earth moving blade moving mechanism on the vehicle, and (2) the earth moving blade mechanism being movable between a first position in which an earth moving blade is oriented at an oblique angle to the ground and a second position in which the earth moving blade extends in the direction of the surface of the ground;

B) a cable handler which includes (1) a base, (2) a mounting bracket on the base of the cable handler and which is sized and adapted to couple to the earth moving blade mechanism of the earth moving vehicle to be moved thereby, (3) the cable handler being movable between a first position in which a plane containing the cable handler is oriented at an oblique angle to the ground when the earth moving blade mechanism is in the first position thereof and a second position in which the cable handler is oriented to extend in the direction of the surface of the ground when the earth moving blade mechanism is in the second position thereof, (4) a first spool element mounted on the cable handler, the first spool element including (a) a cylindrical base, and (b) a plate which is unitary with the cylindrical base of the first spool element, and (c) a gap defined between the plate of the first spool element and the base of the cable handler, (5) a second spool element mounted on the cable handler, the second spool element including (a) a cylindrical base, and (b) a plate which is unitary with the cylindrical base of the second spool element, and (c) a gap defined between the plate of the second spool element and the base of the cable handler, and (6) the gaps defined on the first and second spool elements being sized and adapted to accommodate cable which is wound around the cylindrical bases of the first and second spool elements so the cable will be retained on the base of the cable handler between the base of the cable handler and the plates of the first and second spool elements to move with the base of the cable handler.

* * * * *